United States Patent [19]

Dalsin

[11] Patent Number: 4,554,863

[45] Date of Patent: Nov. 26, 1985

[54] CHIMNEY DAMPER

[75] Inventor: Bernard L. Dalsin, Edina, Minn.

[73] Assignee: Bernard Dalsin Manufacturing Company, Bloomington, Minn.

[21] Appl. No.: 607,785

[22] Filed: May 7, 1984

[51] Int. Cl.[4] ..... F23L 17/10

[52] U.S. Cl. ..... 98/59; 126/286

[58] Field of Search ..... 49/379; 98/59, 67; 126/286, 288

[56] References Cited

U.S. PATENT DOCUMENTS

| | | | |
|---|---|---|---|
| 3,101,039 | 8/1963 | Duchene et al. | 98/59 |
| 3,730,112 | 5/1973 | Hutchinson et al. | 98/59 X |
| 4,020,754 | 5/1977 | Dalsin et al. | 98/59 |

FOREIGN PATENT DOCUMENTS

| | | | |
|---|---|---|---|
| 1344498 | 1/1974 | United Kingdom | 98/59 |

*Primary Examiner*—Harold Joyce

*Attorney, Agent, or Firm*—James R. Haller; Gregory P. Kaihoi

[57] ABSTRACT

A chimney damper attachable to the top of a chimney flue. The damper is characterized by including a frame mountable to and extending above the chimney flue, a damper plate suspended from the frame, above and in alignment with the flue opening, by an expansion spring, and a vertical stem resiliently attached to the damper plate and extending downwardly therefrom. The stem is mounted to the chimney flue so as to allow vertical movement thereof, and is connected by a cable to a control mechanism mounted in the fireplace opening. The control mechanism, in cooperation with the expansion spring, allows selective movement of the damper plate toward and away from the flue opening to control or eliminate movement of air through the flue. The resilient mounting of the stem to the damper plate allows the latter to pivot with respect to the stem, promoting a tight seal between the damper plate and the flue.

8 Claims, 9 Drawing Figures

Fig.3
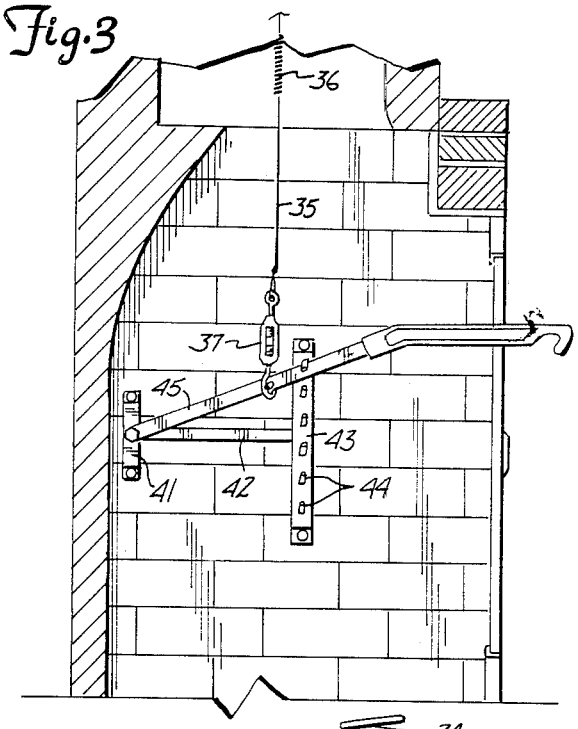
Fig.4
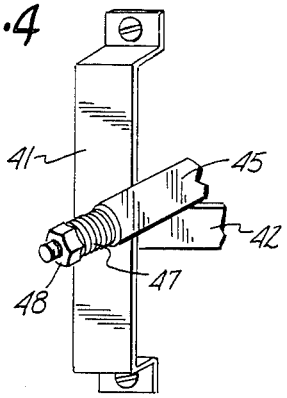
Fig.5
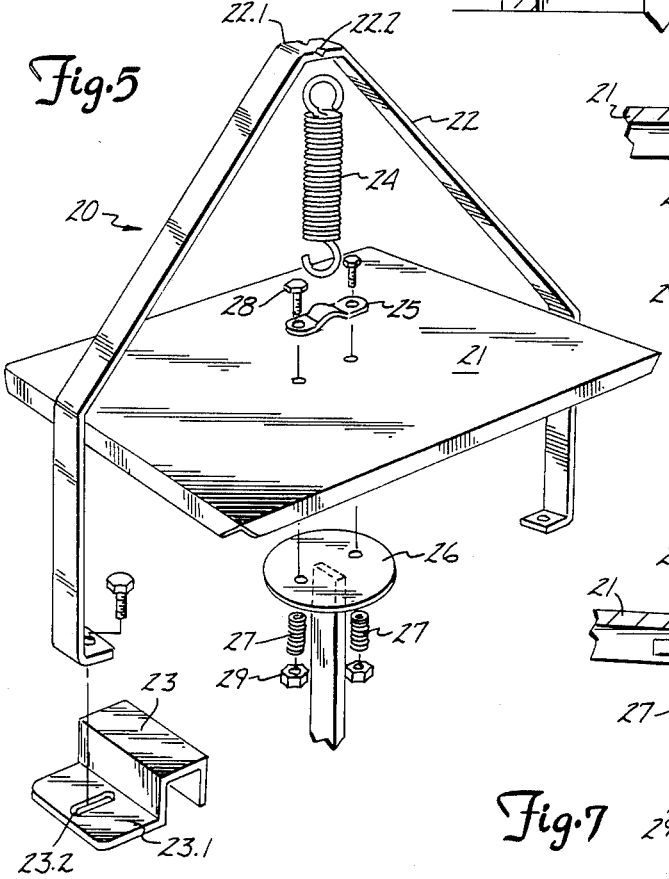
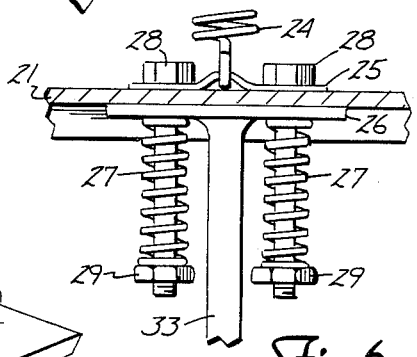
Fig.6
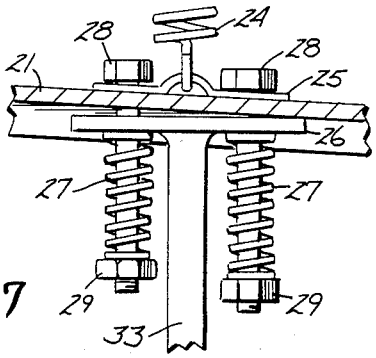
Fig.7

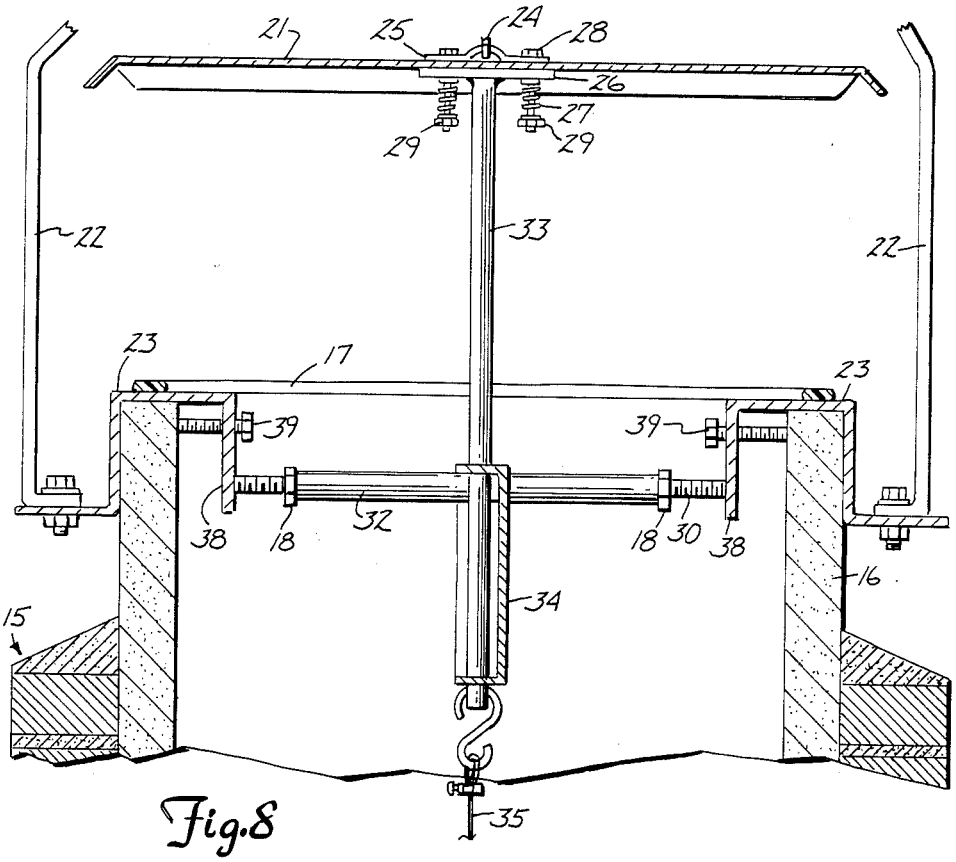
Fig.8
Fig.9
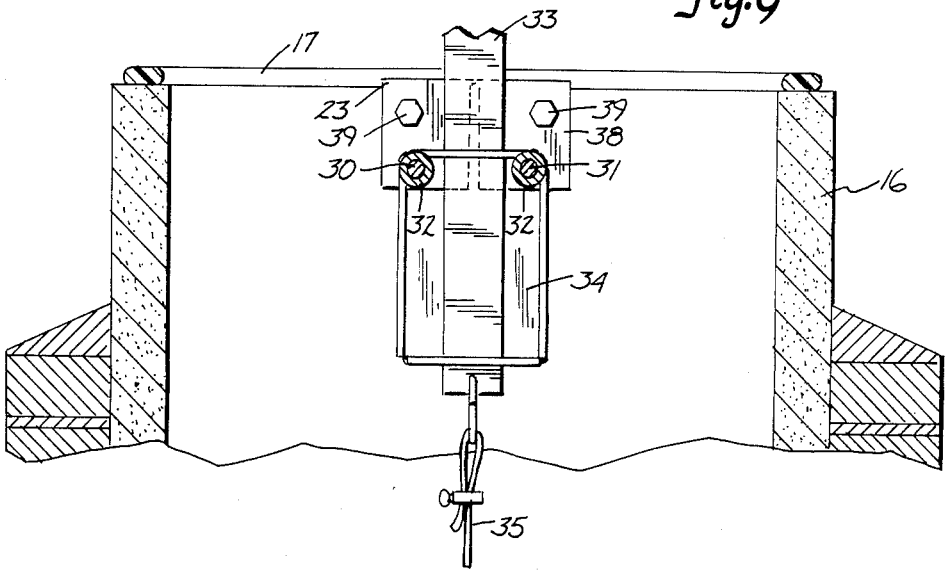

CHIMNEY DAMPER

FIELD OF THE INVENTION

The invention relates to chimney dampers, and more particularly, to chimney dampers attached to the top of a chimney flue.

BACKGROUND ART

A fireplace in a home or other building commonly is connected by a generally vertical chimney flue to the outside of the building. Smoke from the fire therefore passes up the flue to the outside, as desired. Most fireplaces additionally are provided with a damper which can be closed to restrict air flow through the chimney flue when the fireplace is not being used. Traditionally these dampers have been installed near the base of the flue, but more recently models have been devised for installation at the top of the flue as well.

Traditional dampers installed near the base of flue often do not adequately seal the air passageway, therefore allowing considerable cold air to enter the dwelling even when the damper is in the closed position.

Dampers constructed to be installed at the top of a flue have been somewhat more successful in sealing the air passageway, but at the expense of considerable mechanical apparatus which involves excessive cost, weight, and proneness to failure, particularly under the extreme temperature variations which accompany fireplace use. Reference is made to U.S. Pat. No. 4,020,754, which describes one such damper. Damper devices located at the top of a flue typically include a spring for urging the damper open. Such springs and their accompanying apparatus are subjected to high temperatures during use of the fireplace, and to even higher temperatures in the event of a chimney fire. Such temperatures can damage the damper, changing the normal, relaxed position of the spring, and eliminating or reducing the ability of the spring to function properly.

DISCLOSURE OF INVENTION

The invention provides a chimney damper attachable to a chimney flue having an upwardly facing, generally planar peripheral surface defining an upwardly open flue. The damper comprises a frame which is mountable to the open periphery of the chimney flue and which has a superior portion oriented to extend above the flue opening, and flue cover means comprising a thin, generally rectangular metal plate having a generally planar peripheral portion to seal against the upwardly facing surface of a flue opening. Extending between the flue cover means and the superior portion of the frame is spring means, desirably in the form of a helical metal spring, for normally biasing the flue cover means upwardly away from the flue opening, the flue cover means being positioned between the spring means and the flue opening and serving to protect the spring means from heated gases emanating from the flue opening. Control means are provided for urging the flue cover means downwardly, in opposition to the spring means, into sealing contact with the flue opening, the control means including lock means for maintaining the flue cover in its sealing position and adapted to be positioned and operated remotely from the flue opening.

In a preferred embodiment, the flue cover means includes a generally rigid elongated stem movable vertically upwardly and downwardly in response to force exerted by the spring means and control means, respectively, and also having a generally horizontal stem plate carried at its upper end for engagement with the bottom surface of the metal plate of the flue cover means, said plates being biased toward each other by second spring means which allows limited vertical movement and tilting of the flue cover plate with respect to the stem plate. The second spring means preferably comprises at least two pins mounted to either the metal flue cover plate or the stem plate and passing through orifices in the other plate. Compression springs carried out about the pins between spring seats at their ends and the adjacent plate surface urge the stem plate and the flue cover plate together.

BRIEF DESCRIPTION OF DRAWINGS

FIG. 3 is a side elevation view of the control means and fireplace shown in FIG. 2;

FIG. 4 is a broken-away perspective view of a pivot joint of the control device shown in FIG. 3;

FIG. 5 is a partial exploded perspective view of the damper of FIG. 1;

FIG. 6 is a cross-sectional view taken along line 6—6 of FIG. 1;

FIG. 7 is a view similar to FIG. 6 but showing the apparatus in a moved position;

FIG. 8 is a cross-sectional, broken-away elevation of FIG. 1 taken along line 8—8 thereof; and FIG. 9 is a cross-sectional broken-away elevation of FIG. 1 taken along line 9—9 thereof.

BEST MODE FOR CARRYING OUT THE INVENTION

Figure 1:
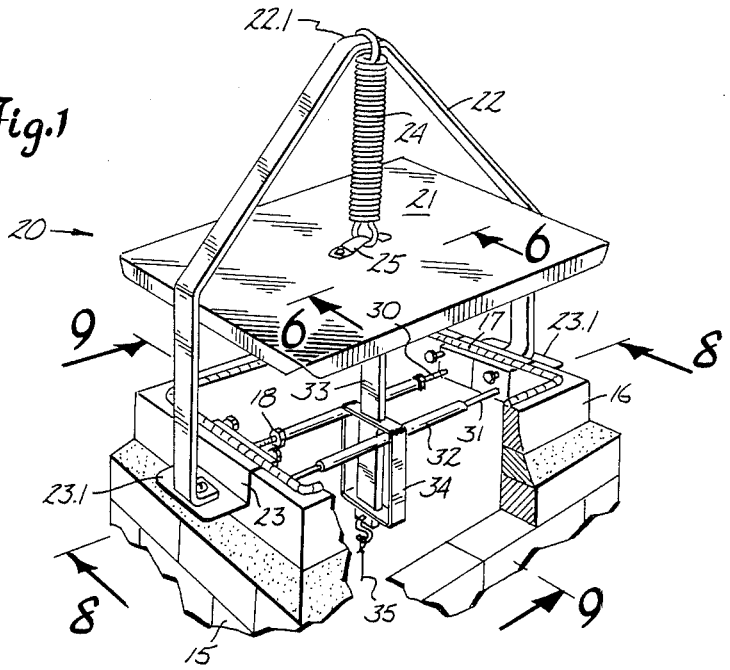
FIG. 1 is a perspective, broken-away view of the chimney damper of the invention installed at the top of a chimney flue.

Referring to FIG. 1, a chimney damper (20) is shown mounted to the chimney (15), and in particular, to the top portion of the chimney flue (16), the flue presenting an upwardly facing, generally planar peripheral surface defining the upwardly open flue passageway which allows smoke and combustion materials from a fireplace fire to escape to the outside.

The chimney damper (20) is characterized by including a frame (22) which is mounted to the open periphery of the chimney flue (16) and has a superior portion (22.1) which is oriented to extend above the flue opening, desirably positioned centrally of the flue opening. Suspended from the superior portion of the frame (22) by extension spring (24) is the flue cover (21), attached by means of a bracket (25) and bolts (28). The cover (21) is preferably fabricated from a thin metal plate, and although the plate shown in FIG. 1 is generally planar in configuration, a variety of shapes could be utilized so long as the configuration includes a generally planar peripheral portion to seal against the top of the flue (16). The frame (22) is preferably comprised of metal strapping having a pair of legs attachable at opposite sides of the flue opening and converging upwardly to an apex (22.1) located centrally of the flue opening. The extension spring (24) is attached at its upper end to the apex (22.1), as shown in FIG. 1. Preferably the apex (22.1) includes a spring-receiving groove (22.2) to prevent the spring (24) from being dislodged from its proper position. (See FIG. 5).

In a preferred embodiment, the cover plate (21) is fabricated from a sheet of sheet metal, preferably about 16 gauge, and in order to impart added rigidity to the plate (21), the extreme edges of the plate are bent downwardly, as shown more clearly in FIG. 8. This configuration can easily be attained by first removing, with a single straight line cut, a triangular piece of metal from each corner of the plate (21), and then bending the edge downwardly to form an obtuse angle with the plate.

As can be seen from FIGS. 1, 2, 5, and 8, the cover plate (21) is connected to a vertically movable stem (33) by means of a stem plate (26), and the stem (33) in turn is operatively linked by a cable (35) to a control device (40) remotely mounted within the fireplace opening. By operating the control device (40), the plate (21) can be pulled downwardly to cause the peripheral planar portion of the cover plate (21) to engage the upwardly facing, generally planar surface of the flue (16), preventing air from entering or exiting the flue chamber. When the control device (40) is released, extension spring (24) returns the flue cover (21) to the open position.

It may be appreciated that extension spring (24) is very important to the proper operation of the damper, and that because it is located above the cover plate (21), it is protected from damage which might be caused by the heat of gases emanating from the chimney flue. Even under the extreme heat generrated by a chimney fire, the spring (24) is shielded by the cover plate (21). The design of the damper therefore provides for increased safety and assurance that the damper will not malfunction under even the most extreme temperature conditions. It may further be noted that the spring (24) undergoes significant dynamic stretching only when the damper is being closed after a fire has been extinguished. In the unlikely event that the spring (24) would fail at all, such failure would probably occur during dynamic stretching and hence would not likely produce any significant adverse consequences.

The damper plate (21) is attached to the stem (33) by means of a stem plate (26), bolts or other pins (28) and compression springs (27), as shown in FIGS. 5, 6, 7, and 8. Referring in particular to FIGS. 6 and 7, it can be seen that the compression springs (27) allow for a firm but resilient linkage between the stem plate (26) and the damper plate (21). The bolts or pins (28) extend through orifices in the respective plates and include spring seats, defined in the drawings by nuts (29), for the compression springs (27) which extend between the nuts (29) and the stem plate (26). Although the drawings illustrate the damper with two such compression springs (27), it will be appreciated that any number of such springs, preferably oriented generally equiangularly of the stem (33), could be utilized; alternately a single spring concentric to the stem (33) could be employed. The described linkage allows the damper plate (21) to tilt in any direction to provide a snug seal between the peripheral portion of the damper plate (21) and the upwardly facing surface of the flue (16). This feature compensates for misalignment of the damper plate (21) with respect to the top surface of the flue (16), which may easily occur if the flue tile was not cut at a perfect 90° angle. The peripheral edge of the stem plate (26) serves as a fulcrum about which the damper plate (21) pivots, as can be seen in FIG. 7. Preferably the stem plate (26) is disc-shaped, i.e., having a circular periphery, to allow universal tilting movement of the damper plate (21) in any direction.

The springs (27) generally will be unaffected by normal combustion gas temperatures. In the event of a chimney fire which would expose the springs (27) to more extreme temperatures, the springs (27) may "take a set"—i.e., the configuration of the springs (27) during exposure to the high temperature would become the configuration of the springs at rest. This would not affect the functioning of the damper in any important respect, however; although the consequent reduction in spring pressure might cause some looseness in the respective parts, this poses no safety danger whatsoever, and the problem can be rectified by merely tightening the nuts (29) about one-eighth of an inch (about 3 mm). Alternatively, the springs (27) could be positioned above the damper plate (21), thereby being protected from heat by the plate (21).

In addition to the aforementioned functions of the springs (27), they also serve to absorb shock from high wind conditions, reducing wear on the other parts of the chimney damper, and facilitate proper operation of the control device (40), as will be explained in further detail below.

Although the above-described universal tilting movement of the damper plate (21) provides for a tight seal between the damper plate (21) and the upward-facing periphery of the flue (16), it is desirable to also provide a resilient gasket (17) on the upward-facing surface of the flue (16) to enhance the seal between the respective parts. Such a gasket may be comprised of any suitable material, but silicone rubber has given particularly good results.

In a preferred method of forming this gasket, a sheet of polyethylene is secured to the bottom side of the peripheral portions of the cover plate (21) by tape or other suitable means attached to the periphery of the plate (21). A bead of silicone (or other suitable material) is then deposited upon the top surface of the flue (16), as shown in FIGS. 1, 8, and 9. Before the silicone (or other material) cures or solidifies, the cover is moved to the closed position to mold the head into a custom-fitting seal between the flue (16) and the damper (21). After the gasket material has cured, the layer of polyethylene is freed from the plate (21) either by removing the tape or by slicing the polyethylene with a razor blade or other device, allowing the plate (21) to be returned to the open position. The remaining polyethylene need not be manually removed, as it will harmlessly burn away when the fireplace is used.

Referring to FIGS. 8 and 9, a preferred means of mounting the stem (33) to the chimney flue (16) is shown. The stem (33) is carried in a stem guide (34) which allows only vertical movement of the stem (33). In a preferred embodiment the stem guide (34) includes upper and lower spaced shoulders, rigidly connected, having aligned, stem-receiving slots formed therein. The stem guide (34) in turn, is rigidly carried by a pair of rods (30) and (31) which are secured to the flue (16) by means of mounting brackets (23). As can be seen in FIG. 8, the mounting brackets (23) are generally "C-shaped", the distance between the opposing legs of the "C" being somewhat greater than the thickness of the flue wall (16). At least a pair of spaced mounting screws (39) are threadingly received within the inner leg of the bracket (23) and secure the bracket against the flue wall (16).

The inner leg of each bracket is cantilevered with respect to the bolts (39) and the flue wall (16), the cantilever portion being designated generally as (38). The rods (30) and (31) are secured to the cantilever portion (38) of the bracket (23) at their respective ends. The cantilever design of the apparatus allows for considerable thermal expansion along the length of rods (30) and (31) under extreme temperature ranges. This feature allows the brackets to be tightly fastened to the flue wall (16) without risking the possibility of cracking the flue tile from thermal expansion of the rods (30) and (31), even under chimney fire conditions. As can be seen in FIG. 9, each of the rods (30) and (31) can be allowed to expand and contract independently of the other by providing a slot between the respective halves of the cantilevered portion (38) of the bracket (23) so that the halves can move independently. The brackets (23) also preferably include an outwardly extending shoulder (23.1) having a slot (23.2) for attachment of the frame (22) (see FIG. 5). The slot (23.2) allows for adjustments and proper alignment of the respective parts.

Referring now to FIGS. 1 and 8, in a preferred embodiment the stem (33) and stem guide (34) can be moved longitudinally along the rods (30) and (31) by providing tubes (32). The stem guide (34) is secured by welding or similar means directly to the tubes (32), which snugly but slideably receive the rods (30) and (31). Rod (30) is threaded, and the tube is adjustably positioned along the rod length by the nuts (18).

Figure 2:
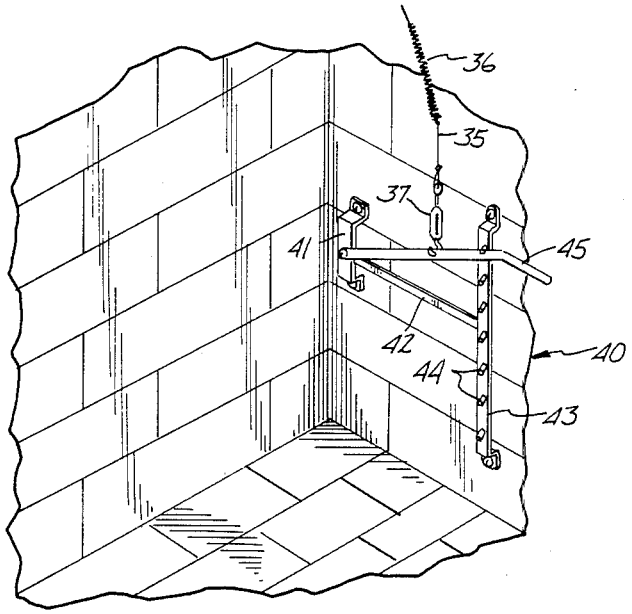
FIG. 2 is a perspective, broken-away view of a control means of the invention installed inside a fireplace.

Although the control device (40) may comprise substantially any suitable apparatus which can selectively pull the stem (33) downwardly and release it, a preferred device is depicted in FIGS. 2, 3, and 4. In this embodiment a stainless steel cable, preferably having a test strength of about four hundred pounds, is attached at one end by an "S" hook to the stem (33), and at the other end to a control device (40). The preferred control device (40) includes a rear bracket (41), a brace (42), and a locking bar (43), with a lever (45) pivotally attached to the rear bracket (41). The rear bracket (41) and the locking bar (43) are anchored to the wall of the fireplace. As shown in FIG. 4, the lever (45) is attached to the rear bracket (41) by means of a nut and bolt (48) and compression spring (47), this combination allowing the lever to be pivoted vertically and also to be moved resiliently horizontally, the compression spring always urging the lever (45) toward the adjacent wall of the fireplace. The locking bar (43) is provided with a series of outwardly and downwardly extending, vertically spaced retaining hooks (44) which resist upward movement of the lever (45). The length of the cable (35) is adjusted to maintain tension on the damper spring (24) at all times. FIG. 3 shows the lever in the raised position, corresponding to the open position of the damper. In this position, the tension on the cable is somewhat reduced as the extension spring (24) is close to its relaxed position; nevertheless a certain amount of tension is maintained to hold the lever (35) against the retaining hook (44).

The damper can be partially closed by moving the lever (45) to successively lower retaining hooks (44), until it is entirely closed. In the closed position, the damper plate (21) will be firmly seated against the gasket (17) on the top of the flue (16), and the compression springs (27) allow the lever (45) to be latched on a retaining hook (44) while maintaining the necessary pressure of the damper plate (21) against the gasket (17). A turnbuckle (37) may be provided to fine tune the adjustment of the length of the cable so that the proper tension may be maintained on the cable (35) when the damper (21) is in the closed position.

Because the cable (35) may have to bend past certain ledges and corners in the chimney flue, in order to reduce wear on the cable, it is desirable to place a flexible sheath around the cable at these corners. The cable (35) may be provided with a length of such a sheath, and during installation of the unit the sheath (36) can be slid manually to the proper location within the chimney flue. Tension on the cable (35) at all times during operation of the device will cause the sheath (36) to maintain its proper location at the corners, allowing the cable (35) to move freely without undue wear.

Although a variety of materials may be used to manufacture the various parts of the apparatus, steel and sheet metal formed by welding techniques has worked very well. The materials must of course be able to withstand a broad range of temperatures without losing the required strength and/or flexibility. The external parts should also be able to withstand weathering over a considerable period of time.

Installation and use of the invention are relatively straightforward in light of the foregoing discussion. The damper assembly is carried to the top of the chimney and secured atop the chimney flue (16) as described. The cable (35) is dropped down the chimney flue, and secured to the control device (40) within the fireplace opening. A gasket (17) may be laid on the top surface of the flue, as previously described, and turnbuckle (37) may be adjusted to provide optimum tension on the cable (35) in the closed position. When a fire is to be lit in the fireplace, the damper is opened by moving lever (45) to the proper location for control of the draft, as desired. When the fire has completely burned out, the damper is then closed.

The invention therefore provides a relatively inexpensive, easily manufactured, lightweight chimney damper for installation on the top of a chimney flue. The damper provides for a tight seal against movement of air, even on chimneys that have flue tile not cut at a precise 90° angle. The spring which opens the damper is safely protected from excessive heat caused by normal fires, and even abnormal chimney fires, and the mounting device is designed to prevent cracking of the chimney flue due to expansion of the various parts even under extreme temperature conditions.

While a preferred embodiment of the present invention has been described, it should be understood that various changes, adaptations and modifications may be made therein without departing from the spirit of the invention and the scope of the appended claims.

What is claimed is:

1. A chimney damper attachable to a chimney flue having an upwardly facing, generally planar peripheral surface defining an upwardly open flue opening, comprising:

(a) a frame mountable to the open periphery of a chimney flue and having a superior portion oriented to extend above said flue opening;

(b) flue cover means comprising a thin, generally rectangular metal plate having a generally planar peripheral portion to seal against the upwardly facing surface of a flue opening;

(c) mounting means for mounting the flue cover means to the chimney flue;

(d) spring means extending between the flue cover means and the superior portion of the frame for spring biasing the flue cover means upwardly away from the flue opening, the flue cover means serving to protect the spring means from heated gases emanating from the flue opening; and (e) control means for urging the flue cover means downwardly, in opposition to the spring means, into sealing contact with a flue opening, the control means including lock means for maintaining the flue cover in its sealing position.

2. The chimney damper of claim 1 wherein the mounting means further comprises a generally rigid elongated stem moveable vertically in response to the spring means and the control means, respectively, a generally horizontal stem plate carried at the upper end of the stem for engagement with the bottom surface of the metal plate of the flue cover means, and spring attachment means resiliently biasing said plates toward each other but allowing resilient tilting of the flue cover plate with respect to the stem plate.

3. The apparatus of claim 2 wherein the spring attachment means comprises one or more compression springs located generally equiangularly of the stem, and a pin corresponding to each spring, each pin being carried by one plate, extending through an orifice in the other plate, and terminating in a spring seat, the corresponding spring extending from the spring seat to the nearer plate and urging the two plates together.

4. The chimney damper of claim 3 wherein the stem plate is disc-shaped, the circular edge thereof serving as a fulcrum as the flue cover plate is tilted with respect to the stem plate.

5. The chimney damper of claim 2 wherein the mounting means includes:

(a) mounting brackets attachable to opposite sides of a chimney flue, each bracket having a cantilever portion positioned to lie at the interior of the flue, and rods extending between and joined to the cantilever portions of the opposing bracket; and (b) stem guide means carried by the rods for securing the stem against rotational and horizontal movement, while allowing vertical movement thereof.

6. A chimney damper attachable to a chimney flue having an upwardly-facing, generally planar peripheral surface defining an upwardly open flue opening, comprising:

(a) a frame mountable to the open periphery of a chimney flue and having a superior portion oriented to extend generally centrally above said flue opening;

(b) flue cover means comprising:

(i) a thin, generally rectangular metal plate having a generally planar peripheral portion to seal against the upwardly facing surface of a flue opening; and (ii) a generally rigid elongated stem moveable vertically, a generally horizontal stem plate carried at the upper end of the stem for engagement with the bottom surface of the metal plate of the flue cover means, and spring attachment means resiliently biasing said plates toward each other but allowing resilient tilting of the flue cover plate with respect to the stem plate;

(c) mounting means for mounting the flue cover means to the chimney flue, including:

(i) mounting brackets attachable to opposite sides of a chimney flue, each bracket having a cantilever portion positioned to lie at the interior of the flue, and rods extending between and joined to the cantilever portions of the opposing bracket; and (ii) stem guide means carried by the rods for securing the stem against rotational and horizontal movement, while allowing vertical movement thereof;

(d) spring means extending between the flue cover means and the superior portion of the frame for spring biasing the flue cover means upwardly away from the flue opening, the flue cover means serving to protect the first spring means from heated gases emanating from the flue opening; and (e) control means for urging the flue cover means downwardly, in opposition to the spring means, into sealing contact with a flue opening, the control means including lock means for maintaining the flue cover in its sealing position.

7. The apparatus of claim 6 wherein the spring attachment means comprises one or more compression springs located generally equiangularly of the stem, and a pin corresponding to each spring, each pin being carried by one plate, extending through an orifice in the other plate, and terminating in a spring seat, the corresponding spring extending from the spring seat to the nearer plate and urging the two plates together.

8. The chimney damper of claim 6 wherein the stem plate is disc-shaped, the circular edge thereof serving as a fulcrum as the flue cover plate is tilted with respect to the stem plate.

* * * * *